US008544492B2

(12) United States Patent
Sprague

(10) Patent No.: US 8,544,492 B2
(45) Date of Patent: Oct. 1, 2013

(54) VACUUM ACTIVATED POWER TOWER

(76) Inventor: Alden C. Sprague, Huntington Station, NY (US)

( * ) Notice: Subject to any disclaimer, the term of this patent is extended or adjusted under 35 U.S.C. 154(b) by 0 days.

(21) Appl. No.: 13/304,685

(22) Filed: Nov. 27, 2011

(65) Prior Publication Data

US 2012/0068367 A1 Mar. 22, 2012

Related U.S. Application Data

(63) Continuation-in-part of application No. 12/509,443, filed on Jul. 25, 2009, now Pat. No. 8,066,027.

(51) Int. Cl.
*F16L 43/00* (2006.01)

(52) U.S. Cl.
USPC ..... 137/128; 137/124; 137/143; 137/147; 261/122.1

(58) Field of Classification Search
USPC ..... 137/123–128, 136, 138, 139, 142, 137/144, 147; 60/398; 415/108, 119; 290/42, 290/43, 53, 54, 1 R
See application file for complete search history.

(56) References Cited

U.S. PATENT DOCUMENTS

| | | | | | |
|---|---|---|---|---|---|
| 2,401 | A | * | 12/1841 | Johnson | 137/13 |
| 56,597 | A | * | 7/1866 | Naglee | 137/150 |
| 298,805 | A | * | 5/1884 | Weeden | 137/128 |
| 378,811 | A | * | 2/1888 | Tyler | 137/128 |
| 475,396 | A | * | 5/1892 | Hawley | 137/128 |
| 853,705 | A | * | 5/1907 | Lindenberg et al. | 137/128 |
| 2,063,002 | A | * | 12/1936 | Smith | 62/394 |
| 3,426,540 | A | * | 2/1969 | Fixel | 290/42 |
| 3,505,688 | A | * | 4/1970 | Sloan | 137/142 |
| 3,510,884 | A | * | 5/1970 | Sloan | 137/142 |
| 3,569,725 | A | * | 3/1971 | Rosenberg | 290/53 |
| 3,945,211 | A | * | 3/1976 | Rowe | 60/649 |
| 3,956,124 | A | * | 5/1976 | Fast et al. | 210/600 |
| 4,051,204 | A | * | 9/1977 | Muller et al. | 261/36.1 |
| 4,110,058 | A | * | 8/1978 | Langle et al. | 417/395 |
| 4,124,035 | A | * | 11/1978 | Rice | 137/128 |
| 4,132,247 | A | * | 1/1979 | Lindberg | 137/216 |
| 4,180,976 | A | * | 1/1980 | Bunn | 137/123 |
| 4,301,826 | A | * | 11/1981 | Beckerer | 137/149 |
| 4,396,842 | A | | 8/1983 | Juhn | |
| 4,587,435 | A | * | 5/1986 | McCullough | 290/54 |
| 4,617,113 | A | * | 10/1986 | Christophersen et al. | 210/460 |
| 4,624,109 | A | * | 11/1986 | Minovitch | 60/648 |
| 4,743,405 | A | * | 5/1988 | Durao et al. | 261/76 |
| 4,807,674 | A | * | 2/1989 | Sweet | 137/205 |
| 5,034,164 | A | * | 7/1991 | Semmens | 210/640 |
| 5,311,064 | A | * | 5/1994 | Kumbatovic | 290/53 |
| 5,356,076 | A | * | 10/1994 | Bishop | 239/318 |

(Continued)

*Primary Examiner* — Craig Schneider
*Assistant Examiner* — Craig J Price
(74) *Attorney, Agent, or Firm* — Stanley H. Kremen

(57) ABSTRACT

The present invention is a modular tower structure comprising a common up-flow column topped with a covered header to which multiple independent down-flow and scavenger columns are attached. It employs a renewable energy process for extracting energy from the atmosphere. The process works by creating a vacuum into which atmospheric air is drawn through a vacuum operated motor driver. The motor in turn can operate other mechanisms as electric power generators. A scavenger column and a header operate independently to collect and remove air before it can accumulate in the tower header and interfere with the siphon process. The tower header is equipped to remove solids or floatables before they can collect at the top of the header and interfere with the process. The header cover is removable for inspection and ease of maintenance.

10 Claims, 6 Drawing Sheets

(56) References Cited

U.S. PATENT DOCUMENTS

| | | | | |
|---|---|---|---|---|
| 5,507,943 | A * | 4/1996 | Labrador | 210/136 |
| 5,674,433 | A * | 10/1997 | Semmens et al. | 261/37 |
| 5,970,999 | A * | 10/1999 | Greenia | 137/128 |
| 6,239,505 | B1 * | 5/2001 | Kao | 290/42 |
| 6,800,115 | B2 * | 10/2004 | Eimer | 95/215 |
| 6,967,413 | B2 * | 11/2005 | Atiya | 290/43 |
| 6,984,304 | B2 * | 1/2006 | Andrews et al. | 205/626 |
| 7,063,247 | B1 * | 6/2006 | Lund et al. | 227/10 |
| 7,537,200 | B2 * | 5/2009 | Glassford | 261/102 |
| 2005/0230856 | A1 * | 10/2005 | Parekh et al. | 261/122.1 |
| 2006/0144439 | A1 * | 7/2006 | Bell | 137/147 |
| 2010/0071780 | A1 | 3/2010 | Sprague | |

* cited by examiner

VACUUM ACTIVATED POWER TOWER

CROSS REFERENCE TO RELATED APPLICATIONS

The present application is a continuation-in-part of U.S. patent application Ser. No. 12/509,443 (hereinafter, the "Parent Application") filed on Jul. 25, 2009. Said Parent Application is incorporated by reference herein in its entirety. This Present Application claims the benefit of and priority to said Parent Application.

BACKGROUND OF THE PRESENT INVENTION

The relevant prior art discloses a cumbersome and likely unworkable apparatus for extracting energy from atmospheric air, viz., U.S. Pat. No. 4,396,842 issued to Jhun on Aug. 2, 1963 (hereinafter "Juhn"), entitled "Tidal Power Generation Utilizing the Atmospheric Pressure." Referring to FIG. 1 of Juhn, this invention relies on a dam 14 to create two different water levels, A and B. An inverted U-tube structure 20 having perpendicular corners straddles the dam. Juhn employs adjustable floats 50 and a sluice between pools A and B to accommodate continuously varying tidal levels while simultaneously maintaining water tube 20 on the level to avoid air pocket formation along the top 22 of air tube 20. Juhn also places the interface between small bubbles emerging from small holes inn air plate and the flowing medium at the top 22 corner of air tube 20. Flow regulating valves control air and water flow. Juhn furthermore make no provision for initial priming of the system or for purging any air/gas that may accumulate along the top 22 of air tube 20. In addition, because Juhn's inverted U-tube structure 20 straddles dam 14, it is captive to the location and design of the dam.

APPROACH TO SOLVING THE PROBLEM

The Present Invention provides a workable solution to the shortcomings of Juhn. It allows for a remote and/or convenient installation site away from pool A since it need not straddle a dam. A dam may not even be necessary if water is drawn from any elevated source. The Present Invention precludes the need to maintain a balance between pools A and B surface levels exploiting tidal or wave activity since the Present Invention is positioned on the pool B side only. Attached floats or floats combined with a counterweight system allows the Present Invention to automatically adjust to a constantly changing pool A surface level from tidal or wave activity.

The Present Invention overcomes the adverse effect from air/gas accumulation by incorporating a domed header configuration wherein air/gas can gather for removal through the header top via a scavenger system. A priming system necessary for startup is connected via the scavenger line. Microbubble diffusers mounted in the down-flow columns expose emerging small air bubbles directly into the downward flowing medium.

SUMMARY OF THE INVENTION

The Present Invention is a modular tower structure comprising a common up-flow column topped with a covered header to which multiple independent down-flow and scavenger columns are attached. The Present Invention incorporates the renewable energy process for extracting energy from the atmosphere that was disclosed in the Parent Application. The process works by creating a vacuum into which atmospheric air is drawn through a vacuum operated motor driver. The motor in turn can operate other mechanisms as electric power generators.

The scavenger column and header operate independently to collect and remove air and/or gas before they can accumulate in the tower header and interfere with the siphon process. The tower header is equipped for removing solids or floatables before they can collect at the top of the header and interfere with the process. The header cover is removable for inspection and ease of maintenance.

BRIEF DESCRIPTION OF THE DRAWINGS

FIG. 7A illustrates a left-half section elevation.

FIG. 7B illustrates a full section elevation

FIG. 7C illustrates an enclosed full section elevation.

DETAILED DESCRIPTION OF THE INVENTION

The Vacuum Activated Modular Power Tower structure is unique as it can operate on relatively low head hydro resources normally incompatible with other energy producing systems. The modular design allows for a single or multiple unit installation as may be appropriate to any specific and available low head flow volume hydro source. Modules may also be "laddered" to fully exploit higher head but limited volume flow hydro sources. Fabrication using low weight commercially available materials lead to reduced transportation, assembly, foundation and maintenance costs. Minimal foundation requirements lead to minimal environmental impact. The modular design is flexible in that basic components can be arranged for specific applications.

Figure 1:
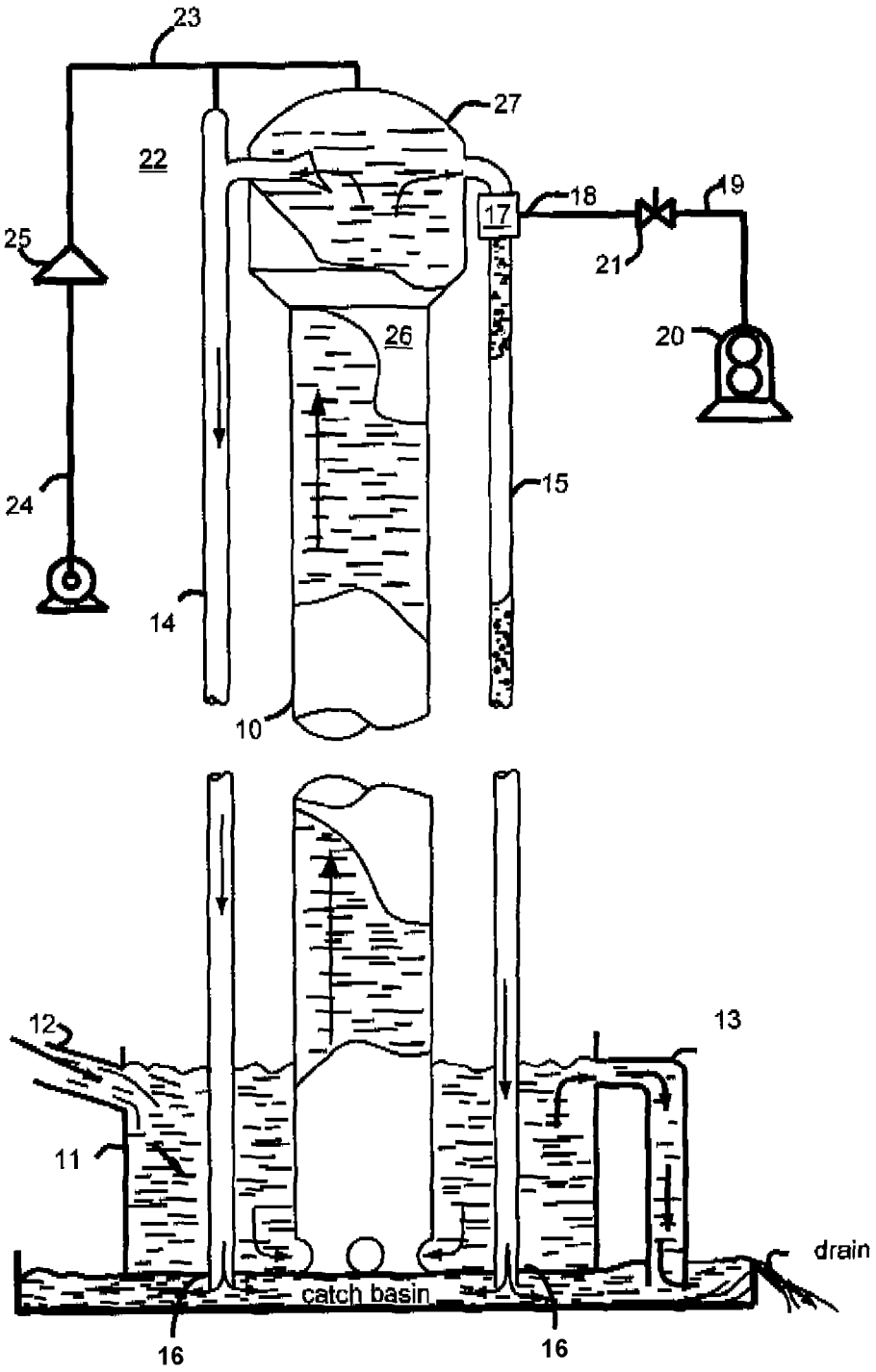
FIG. 1 is a flow diagram of a typical power tower.

Major Power Tower components and relative positions with respect to the process flow are shown in FIG. 1. A center-in-tank up-flow column module as illustrated in the drawing could receive piped in flow from a hydro source while setting in a natural catch basin or in a channel.

Basic components of an exemplary embodiment are shown in FIG. 1. A vertical tower 10 capped with a covered header 26 is seated in an open tank 11. A water inlet manifold 12 and a water overflow fitting 13 are attached to tank 11. Tower 10 has bottom openings. Scavenger column(s) 14 and down-flow column(s) 15 are spaced around the tower header 10. Open tank 11 is supported over a separate drained catch basin. Scavenger and down-flow column(s) 14 and 15 extending downward penetrate the tank 11 bottom and protrude into the catch basin below the basin drain level. Sealing glands 16 close the clearances at the tank 11 base penetrations.

Removable tower header cover 27 seated on the top rim of header 26 and sealed using leak-tight O-ring or equal sealing medium is held securely in place once vacuum is applied. Simple latches 31 (see FIG. 2), which hold the cover 27 in position during shipment, erection and start-up also allow easy access to the header for maintenance.

Figure 2:
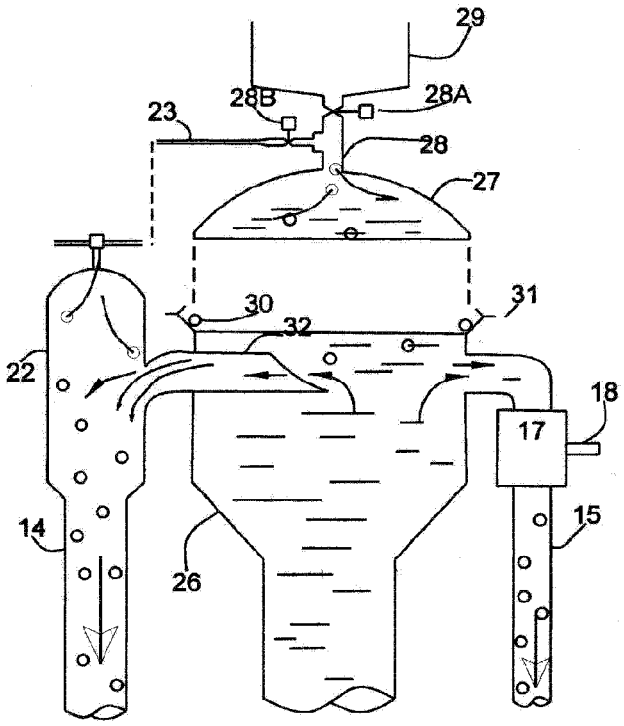
FIG. 2 is a sectional view and process flow for a tower header and components.

Internal scoop 32 mounted inside of header 26 connects to scavenger column header 22 are shown in FIG. 2. This provides a means for removing floatable materials and debris from the tower header 26. The vacuum producing interaction between cascading water and the air/gas drawn from the header and entrained in the scavenger column down-flowing water is shown in the drawing. Micro-bubbles introduced into the down-flow water column by the micro-bubble diffuser are also shown in the drawing.

Figure 6:
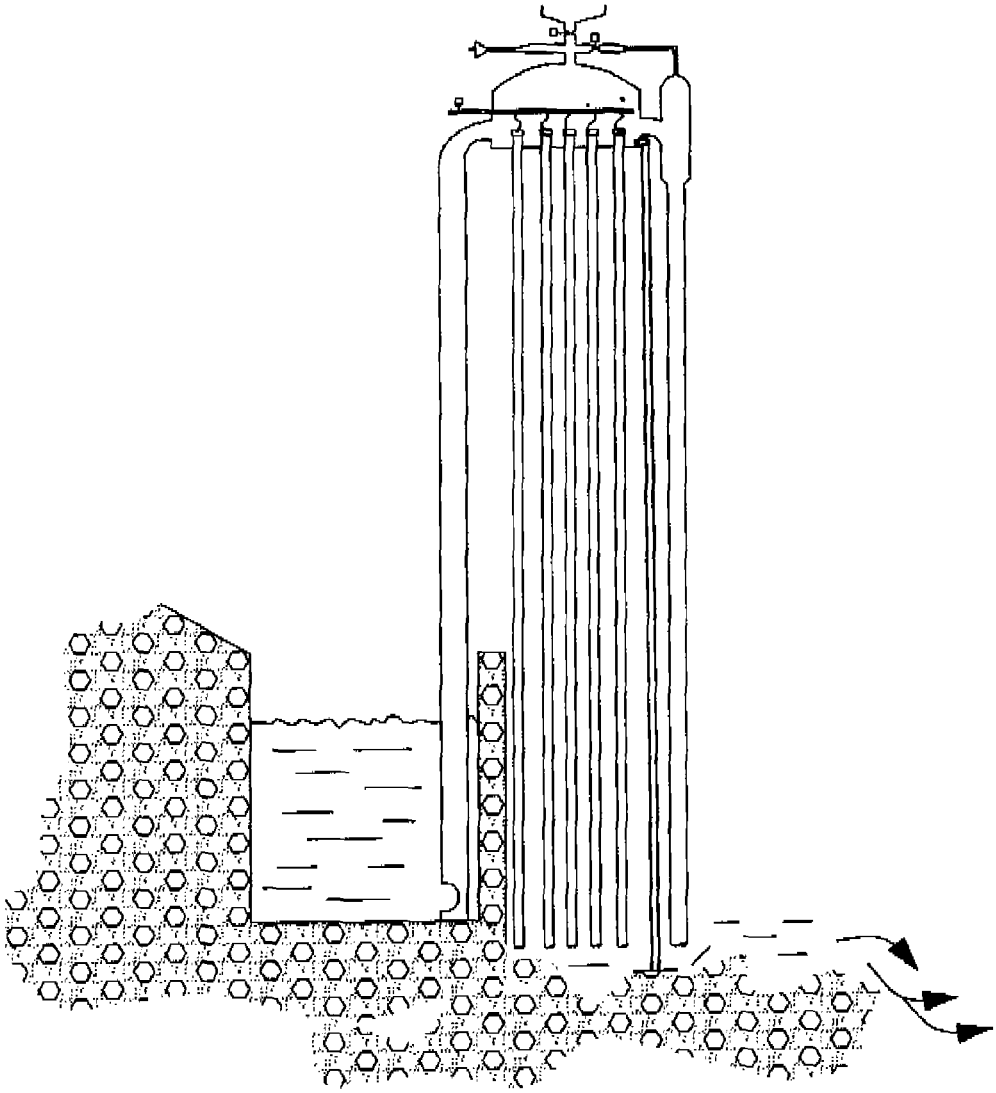
FIG. 6 Illustrates a tower with side entry header positioned adjacent to and feeding from a channel.

A micro-bubble diffuser 17 is mounted in the upper section of each down-flow column 15 as shown in FIGS. 1 and 2. Alternatively each diffuser 17 is positioned at the top inlet of the associated down-flow column within the side entry tower header as shown in FIG. 6. A lateral line 33 (see FIG. 3) connects each diffuser 17 to a vacuum flow line 19 (see FIG. 1). Flow line 19 connects the micro-bubble diffuser inlet nozzle 18 to a vacuum powered motor 20 exhaust port. A motor start-up valve 21 mounted in flow line 19 isolates the vacuum powered motor 20 from the micro-bubble diffuser 17.

Vacuum flow line 23 connects the top of scavenger column header 22 to the purge manifold 28 mounted at the top of header cover 27 and to the inlet port of the vacuum priming start-up pump 24. Vacuum backflow check valve 25 is mounted in vacuum line 23 between the vacuum priming pump 24 and the top of scavenger column header 22.

System start-up begins with filling open tank 11 from a continuously available water source entering through inlet manifold 12. Once tank 11 is filled, excess water passing through overflow fitting 23 will fill the separate catch basin which in turn will overflow when the drain level is reached. Once the separate catch basin is filled to overflow with the protruding lower ends of scavenger and down-flow columns 14 and 15 are submerged (FIG. 3), the system may be primed by evacuating all air and/or gas from the system using the vacuum priming start-up pump 24. Vacuum motor start-up valve 25 is closed during the priming phase. Siphoning of water from filled tank 11 into the catch basin will immediately begin once all air/gas have been removed from all columns and displaced with water. The natural force motivating upward flow in tower 10 and downward flow in the scavenger and down-flow columns 14 and 15 is the differential head between the filled tank surface and the separate catch basin drain level shown in FIG. 1.

Once siphoning begins, vacuum priming pump 24 is shut down. Check valve 25 in vacuum flow line 23 prevents air back streaming, which could disrupt the siphoning action.

The source of supplementary vacuum necessary to sustain continuous siphon flow with the vacuum priming pump 24 out of service is the gas entrainment process occurring within the scavenger column header 22 illustrated in FIG. 2. Air and/or gas, as they may appear in the tower header 26, are drawn via vacuum flow line 23 into scavenger column header 22 before they can accumulate and interrupt the siphon effect. While minimal, the vacuum pumping speed generated by a working model scavenger column is sufficient to support a tower and several down-flow columns. Additional scavenger columns could provide additional pumping speed, as might be needed for a tower header with multiple down-flow columns or if outgassing is excessive.

Once siphon flow attains a steady state, motor start-up valve 21 is opened to allow atmospheric air to flow through vacuum operated motor 20 to micro-bubble diffuser 17 via flow line 19. Motor 20 will begin operating immediately when a vacuum is applied and atmospheric air passes through.

Figure 3:
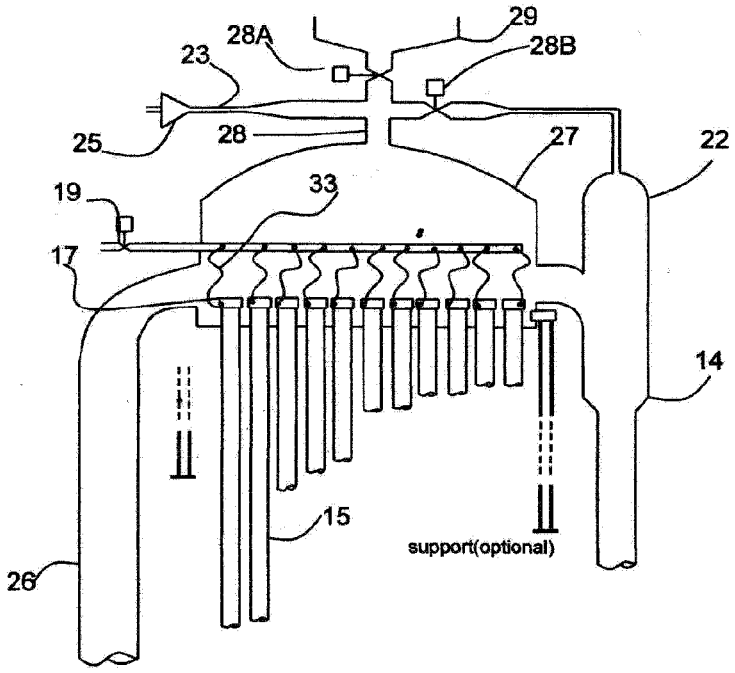
FIG. 3 is a cross-section of a side inlet tower header.

FIG. 3 is a cross-section of a side-inlet tower header. The side-entry tower header can accommodate a more compact multiple element down-flow tube nest. Micro-bubble diffusers are inside the tower header as shown. Major components of micro-bubble diffuser 17 (see FIGS. 4 and 5) are the outer casing 33, the upper extension 34, the lower extension 35, the porous hydrophobic membrane 36 and the diffuser inlet nozzle 18 as illustrated in FIG. 3. A circumferential cavity 37 in casing 33 encircles porous hydrophobic membrane 36. Extensions 34 and 35 connect respectively to upper and lower down-flow column 15 sections.

Figure 4:
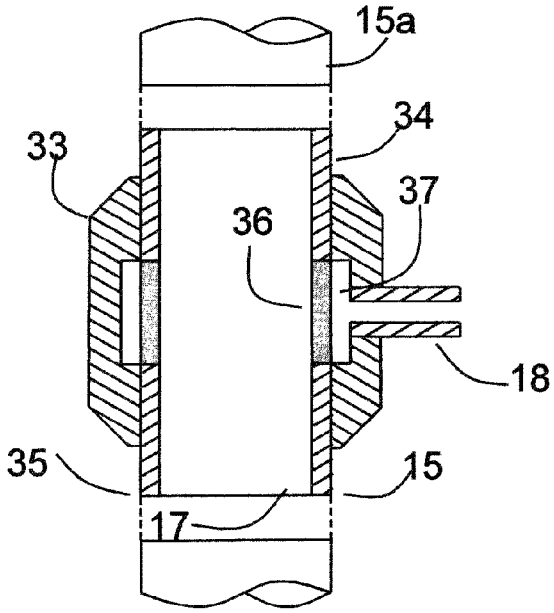
FIG. 4 is a cross-section of a hydrophobic porous membrane micro-bubble diffuser

Major components of a micro-tube type micro-bubble diffuser 17 include the outer casing 33, upper and lower extensions 34 and 35, inlet nozzle 18, cavity 37 with a micro-tube retainer supporting micro-tubes 38 are illustrated in FIG. 4. FIG. 4 is a cross section of the hydrophobic porous membrane micro-bubble diffuser. The path for air entering into the micro-bubble diffuser via the intake fitting and into the circumferential cavity to flow freely around and pass through the porous membrane to be dispersed into the down flowing liquid is illustrated in the drawing.

Figure 5:
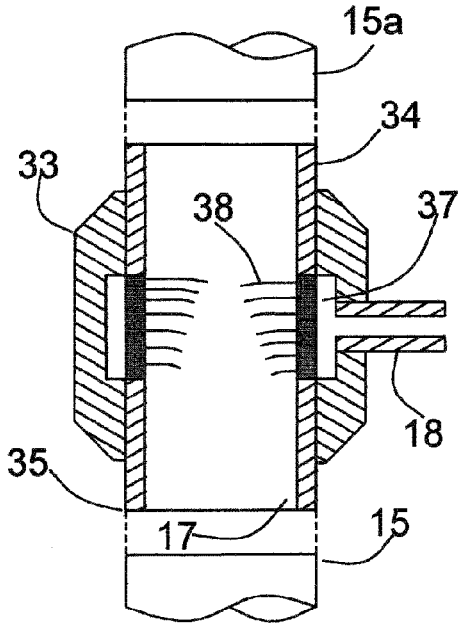
FIG. 5 is a cross-section of a micro-tube type micro-bubble diffuser.

Air drawn into diffuser 17 by the vacuum inherent to a siphon column enters through nozzle 18 into cavity 37 and passes through membrane 36 (or through micro-tubes 38) into down-flow column 15. The air is dispersed as extremely small bubbles as it passes through the hydrophobic micro-bubble diffuser membrane 36 (or through micro-tubes 38, shown in FIG. 5). In FIG. 5, the micro-tubes 38 extend into the liquid and are flexible so as to bend toward the direction of the liquid flowing in the downward direction. Typically, the micro-tubes 38 have diameters less than or equal to ten microns. The micro-bubbles emerging from the diffuser 17 become entrained in the downward flowing liquid by the sweeping effect across the air-liquid interface to be discharged at the bottom of down-flow column 15. The micro-bubbles formed are purposely so small that they are easily swept down and away before they can rise and interfere with the process.

Purge manifold 28 mounted on the header cover 27 (see FIG. 2) includes a normally closed purge valve 28A and normally open shut-off valve 28B as shown in FIG. 2. These valves are activated as needed to remove any debris from the cover 27 air/gas outlet which could interfere with scavenger column 14 operation. Purge vessel 29 mounted on the purge manifold 28 may be filled with liquid. Momentary opening of valve 28A and closing of valve 28B will cause a vacuum induced downward surge, flushing out obstructions.

Purge manifold 28 may be used to facilitate a planned shutdown for maintenance. Opening valve 28A with valve 28B in normal open mode and vessel 29 void of liquid will cause a rapid and safe shutdown as entering atmospheric air displaces liquid.

The modular tower may be maintained in a fully charged static state to accommodate short periods of inactivity without re-priming prior to resuming normal operation by closing valve 21 to shut off air flow to diffuser 17.

A surface level monitoring device (not shown) in tank 11 would signal valve 21 to close prior to sensing a head level insufficient to maintain siphon flow. A tidal operated system typically would encounter changing head levels with the ebb and flow of each tidal reversal. Siphon flow would continue until equilibrium is reached between up-flow and down-flow columns. All columns would then remain fully charged and ready for siphon flow to resume in the absence of any outside air intrusion sufficient to prevent siphon flow. Siphon flow would resume once tank 11 has refilled and valve 21 re-opened on a signal from level monitoring device.

FIG. 5 is a cross-section of a micro-tube type micro-bubble diffuser. The air path is the same as described in FIG. 4 except that the air passing from the circumferential cavity is dispersed as micro-bubbles into the down flowing liquid via micro-tubes.

A side-mounted up-flow column module, as illustrated in FIG. 6, is compatible with differing tank/channel and/or side-to-side arrangements. Using floats, it could be adapted for harvesting tidal activity. A side-mounted up-flow module mounted in a low profile circular floating surface platform designed to exploit ocean wave activity is shown in FIG. 7.

A multiple element tower with a side entry header as shown in FIG. 6 feeds from a channel. While having the necessary additional components as the center mounted tower header, a specially designed base tank is not required for support.

Figure 7A:
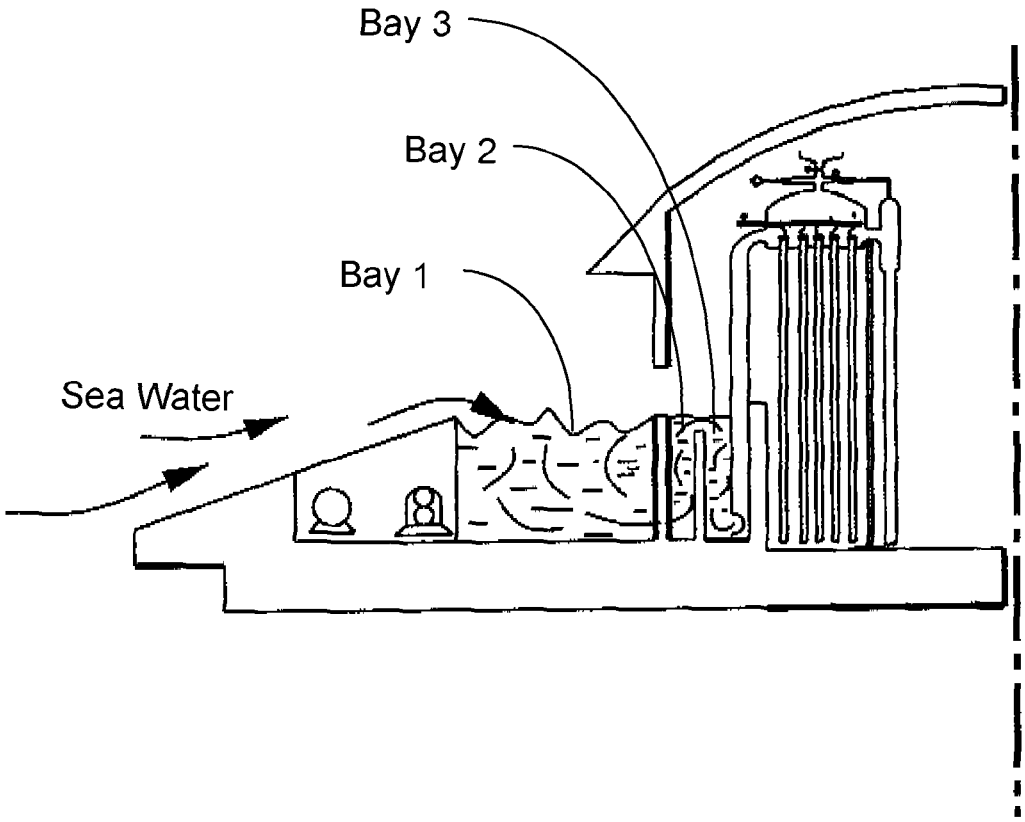
FIG. 7A-7C shows a tower with side entry header positioned in an ocean wave overtopping platform.
Figure 7B:
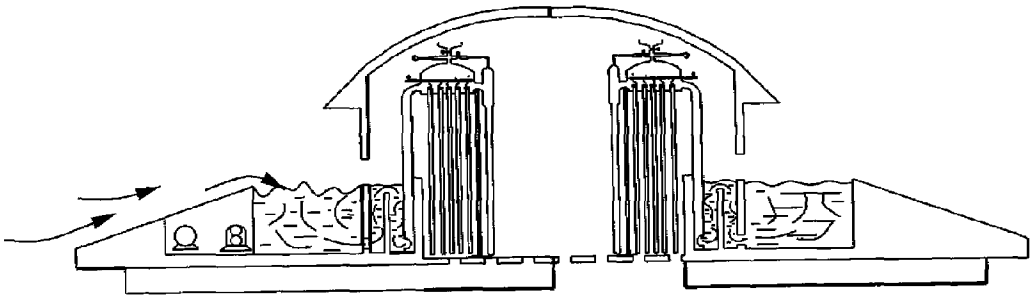
Figure 7C:
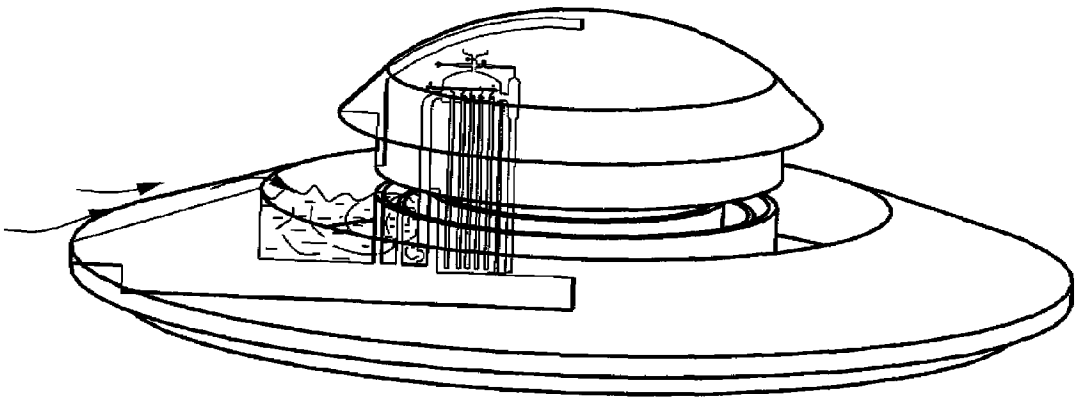

A tower with side-entry header installed in a floating low profile circular ocean wave overtopping platform is shown in FIG. 7. FIG. 7A illustrates a left-half section elevation. FIG. 7B illustrates a full section elevation. FIG. 7C illustrates an enclosed full section elevation. The apparatus has the appearance of a sea-saucer. Sea water elevated by being driven up the inclined ramp by wave action collects in bay 1, progresses into bay 2 and then into bay 3 as shown. The circular shape precludes the need to position the platform facing wind/wave direction. Wave deflectors positioned along the platform ramp help direct sea water toward the center and into bay 1. Sea water having entered the bay 1 wave facing side automatically flows by gravity to the rear and levels out uniformly.

The flow path from bay 1 to bay 3 is designed to minimize carryover of air entrained in the sea water by violent wave action into the tower up-flow column inlet. The bypass between bay 1 and bay 2 is near the bottom of each bay so entrained air will have opportunity to agglomerate into larger bubbles and rise to the surface. The inlet to the tower up-flow column in bay 3 also is purposely positioned as low as possible to allow as much entrained air as possible to be removed from the flow path between bays 2 and 3.

I claim:

1. An apparatus for extracting useful energy from atmospheric air comprising:

a) a vertical tower through which liquid flows upward, said vertical tower being capped with a covered header and seated in an open tank comprising a bottom,
wherein
i) the vertical tower further comprises at least one bottom opening through which liquid enters; and
ii) the covered header has a removable cover; further comprising a top;

b) a liquid inlet manifold attached to the open tank, through which the liquid enters the open tank;

c) a liquid overflow fitting attached to the open tank, through which the liquid exits the open tank;

d) a horizontal catch basin in which the open tank sits, wherein said catch basin comprises a drain, wherein the liquid flows into the catch basin from the liquid overflow fitting, and wherein the liquid flows out of the catch basin through the drain;

e) a plurality of vertical scavenger columns, each comprising a scavenger header, and each connected to the vertical tower via conduits and spaced around the covered header, through which the liquid flows in a downward direction;

f) a plurality of downflow columns, connected to the vertical tower via conduits and spaced around the covered header, through which the liquid flows in a downward direction,
wherein said plurality of scavenger columns and the plurality of downflow columns extend downward so as to penetrate the open tank bottom and protrude into the catch basin below a drain level within the catch basin;

g) a plurality of micro-bubble diffusers extending into the liquid flowing in the downward direction, being of the same number as the number of the plurality of downflow columns,
wherein:
iii) each of said plurality of downflow columns comprises one of said micro-bubble diffusers mounted therein; and
iv) each of said micro-bubble diffusers further comprises an inlet nozzle;

h) a vacuum priming system which initially fills the vertical tower and each of the plurality of scavenger columns and downflow columns with the liquid;

i) a vacuum powered motor; and j) a vacuum flow line connecting the inlet nozzles of said plurality of micro-bubble diffusers to the vacuum motor.

2. The apparatus of claim 1 wherein the priming system comprises a vacuum pump.

3. The apparatus of claim 2 wherein the priming system accesses the vertical tower at the top of the removable cover.

4. The apparatus of claim 1 wherein each of the plurality of micro-bubble diffusers comprises a hydrophobic membrane.

5. The apparatus of claim 1 wherein each of the plurality of micro-bubble diffusers comprises a plurality of tubules having diameters less than or equal to ten microns.

6. The apparatus of claim 5 wherein the tubules are flexible so as to bend toward the direction of the liquid flowing in the downward direction.

7. The apparatus of claim 1 wherein the liquid is water.

8. The apparatus of claim 7 wherein the water is sea water.

9. The apparatus of claim 1 wherein the plurality of scavenger columns and the plurality of downflow columns surround the vertical tower.

10. The apparatus of claim 1 further comprising an internal scoop mounted inside the covered header, wherein said internal scoop connects to scavenger column header, to provide a means for removing floatable materials and debris from the vertical tower.

* * * * *